United States Patent [19]

DiNitto et al.

[11] Patent Number: 4,611,202

[45] Date of Patent: Sep. 9, 1986

[54] SPLIT SCREEN SMOOTH SCROLLING ARRANGEMENT

[75] Inventors: Robert S. DiNitto, Chelsea; Thomas C. Porcher, Stow; John W. Eng, Southborough, all of Mass.

[73] Assignee: Digital Equipment Corporation, Maynard, Mass.

[21] Appl. No.: 543,108

[22] Filed: Oct. 18, 1983

[51] Int. Cl.[4] ..... G09G 1/06

[52] U.S. Cl. ..... 340/724

[58] Field of Search ..... 340/724, 726, 723, 750, 340/798

[56] References Cited

U.S. PATENT DOCUMENTS

| | | | |
|---|---|---|---|
| 4,068,225 | 1/1978 | Lee | 340/724 |
| 4,437,093 | 3/1984 | Bradley | 340/724 X |
| 4,511,962 | 4/1985 | Machida et al. | 340/724 X |

*Primary Examiner*—Gerald L. Brigance
*Assistant Examiner*—Vincent P. Kovalick
*Attorney, Agent, or Firm*—William E. Cleaver

[57] ABSTRACT

The present invention is employed in a system which has a bit map memory connected to a CRT display device and the CRT display device can display a fixed region of information and a scrollable region of information. In a preferred embodiment, the system uses a graphic display control circuit to change starting addresses and length ending values of the fixed and scrollable regions in the bit map memory. By changing the starting address one scan line per frame, without any actual transfer of data in memory, from one location to another location, the present system effects a "smooth" scroll. The system is able to scroll upward and downward. The system uses logic circuitry to load an off screen segment of the bit map memory with additional scrollable information, so that (in an upward scroll load) as a top line of the scrollable information region is no longer displayed, new information will be displayed at the bottom line of said scrollable region. On the other hand during a downward scroll, a bottom line of information on the scrollable region of the screen will fade out and new information is added, from the off screen region, of the bit map memory to provide information for a new top line. In addition the system has the ability to reorganize the information in the bit map memory in the event the size or location of the fixed region is to be altered.

11 Claims, 8 Drawing Figures

SPLIT SCREEN SMOOTH SCROLLING ARRANGEMENT

BACKGROUND

It is generally accepted in the CRT display art that CRT (Cathode Ray Tube) display devices display twenty-four or twenty-five lines of information. If graphic information, such as a scenic view of a countryside or a design, is also displayed then in the more popular prior art, two memory systems are used, one for graphics and one for text while in another version of prior art both graphics and text are stored in a bit map memory. When a CRT display device is being used with a data processing system, as a form of output means, it often occurs that the user wants to see the information contents of a document which, for instance, is more than twenty-four or twenty-five lines long. By way of example, an ordinary business letter is often more than twenty-five lines in length. In such situations, it has become the practice to scroll such a document or scroll the contents thereof. That is to say twenty-four lines of a document are shown on a CRT and after a suitable time has elapsed, each top line disappears as the information is jumped, or stepped, upward on the CRT screen, with lines twenty-five, twenty-six, twenty-seven, etc. being added to the bottom of the screen as lines one, two, three, etc. disappear from the top of the screen. Such an operation is known as whole screen scrolling or single region scrolling. In prior art systems, the text is "jumped" (to the viewer) in a deliberate movement off the screen at the top and onto the screen at the bottom of the scrolling region. The "jump" operation occurs because the starting addresses for successive scanning operations are changed by text line values rather than scan line values. In addition the "jump" phenomenon is present because the data bits are moved from one location in memory to another which cannot be accomplished in one frame without the use of elaborate and expensive hardware. The DEC VT 100 effects a form of split screen smooth scrolling but does not employ a bit map memory which enhances the present operation. If the document to be displayed has a fixed section, or fixed sections, as the case may be, and the user wants only to scroll a scrollable section, then such an operation is known as split screen scrolling as mentioned above in connection with the DEC VT 100. An example of such a situation would be where a business letter is being displayed and the letterhead along with the addressor's name and title might be displayed as the upper fixed section. The body of the letter, starting with "Dear Mr. Jones" down through the closing expression could be the scrollable section, while the bottom fixed section of the letter might have the address of the company and a proper telephone number.

While it is possible in the prior art, to split screen scroll text and graphics, it is not possible to split screen scroll graphics with a smooth operation as explained before. In the present system both text and graphics can be split screen smooth scrolled. If a system of the prior art technology were designed to provide split screen smooth scrolling for both graphics and text it would require circuitry to provide two hundred and forty starting address designations (SAD's) or it would require moving the entire contents of a bit map memory in one vertical sync period (which would be economically unfeasible). In the present system there is a maximum requirement of four SADs and four length ending values. The fact that the off screen section of the bit map memory, in the present system, lies adjacent to a scrollable region in the bit map memory enables the present system to add new information, to be displayed, to the off screen region and utilize the new information in a scrolling operation by advancing the scan of the bit map memory into the off screen region under control of the length value parameter. The present invention provides for a split screen smooth scrolling operation with reduced hardware as compared to the prior art.

SUMMARY

The present system employs only one memory means, the bit map memory, which stores both text and graphic information to be displayed. Accordingly the present system effects a split screen smooth scroll with reduced hardware when compared with the two memory systems. In such a system it is understood that the problems of addressing the salient points to effect the graphic display are numerous and dramatically reduced if a graphics display controller (GDC) is used. The present system takes advantage of the GDC and employs a maximum of four starting addresses and four region length values to provide the addresses for the split screen scrolling operation. The use of a four address technique as provided by the GDC represents a reduction in hardware when compared with a system which requires two hundred and forty addresses. The system further provides for reorganization of the bit map memory to accommodate a change in the arrangement of the display, i.e., a change in the size or location of the fixed and scrolling regions. The present system provides a starting address and a region length value for each fixed region as well as two starting addresses and two region length values for scrolling regions. The system is arranged to have an off screen region (a region of memory which holds information which is not normally displayed) which lies adjacent to a scrollable region of memory. If we consider a split screen scrolling operation wherein the scrolling is upward, it should be understood that the top displayed line (of the scrolling region) fades out and the next lower intelligence line is written into the top line position of the scrollable region on the CRT. Virtually simultaneously therewith new information, to be written into the bottom line position of the scrolling region of the CRT, is transferred to the off screen region of the bit map memory. At this time the region length value provides the impetus for "advancing circuitry" to scan the said next adjacent line, in the off screen region of memory, and the information in that adjacent line becomes the new information which is added to the bottom line of the scrollable region on the display. In accordance with this arrangement, the system continues to scroll the scrollable region. If off screen memory space becomes used up and there is yet scrollable information to be displayed, the system must find memory space to handle such information. The system accomplishes the foregoing by using memory space (in the scrollable region of the bit map memory) which holds information which has already been displayed and previously scrolled off the screen. In this reuse of the scrollable region of the bit map memory, the system addresses the first line of the scrollable region. That first memory line is loaded with new information which will be added as the lowest line of the scrolling text. Each succeeding line of the scrollable region of memory is used again until the scrolling operation is complete. Accordingly the information seen in the scrollable region of the display appears to be coming from a circular or wrap-around memory device.

The objects and features of the present invention will be better understood in view of the following discussion taken in conjunction with the drawings wherein.

Figure 1:
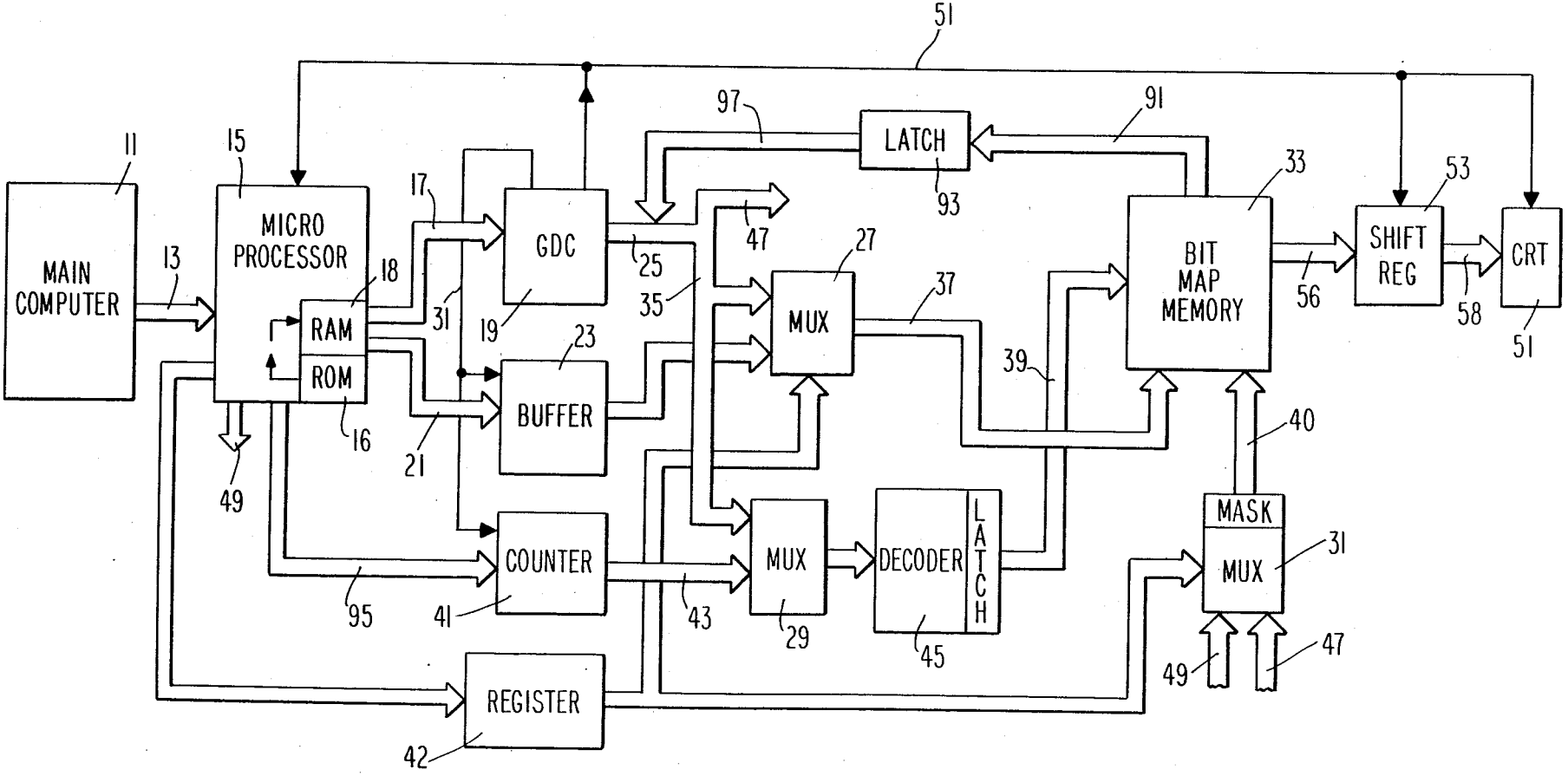
FIG. 1 is a block schematic of the present invention.

Consider FIG. 1. In FIG. 1 there is shown a main computer 11 which is connected through a plurality of input/output channels to many peripherals, in many places, as well as local input and output devices. In FIG. 1 the apparatus connected with channel 13 is one of many output systems with which the main computer 11 operates to provide information for the user. It should be understood throughout the description that the channels, shown in FIG. 1, contain a plurality of parallel wires which carry address information, data information, and instruction information at various times. Connected to the channel 13 is a microprocessor 15. In the preferred embodiment the microprocessor 15 is an 8085 device manufactured by Intel Corporation. The microprocessor 15 includes a random access memory (RAM) as well as a read only memory (ROM). The microprocessor 15 serves as a dedicated slave to the main computer 11. Its dedication being to enable ready access to data information and instruction information for the display circuitry connected thereto.

As can be gleaned from FIG. 1, connected through channel 17 to the microprocessor 15, is a graphic display controller 19 hereinafter referred to as a GDC. The GDC 19, in a preferred embodiment, is a MICRO PD 7220 manufactured by NEC Corporation. Within the GDC 19 there is a write clock generator and for every horizontal blank time there are seven write cycles generated while during every vertical blank time there are 594 write cycles generated. Other clock rates could be used.

Also connected to the microprocessor 15, through channel 21 is a buffer device 23. The buffer device 23 in the preferred embodiment is made up of 74 S 189 devices and a 74 LS 191 device manufactured by Texas Instruments Corporation, although other forms of buffers could be used. The GDC 19 receives instructions and data information signals from the microprocessor 15 and in turn provides address information, instruction information and graphics information on channel 25. The instruction signals on channel 25 control the multiplexer (MUX) 29. MUX's 27 and 31 are controlled by instruction signals from microprocessor 15 through the register 42. The register 42, in the preferred embodiment is a 74 LS 273 manufactured by Texas Instruments Corporation. MUX 27 passes text data signals from buffer 23 and graphics data signals from the GDC 19 in response to write clock signals. The buffer 23 is loaded with 16×10 bits within which a complete character (10×10 bits) is formed. The bit signals from the buffer 23 are advanced 16 bits at a time to the MUX 27 and therethrough to the bit map memory 33. In the preferred embodiment the bit map memory consists of 64K by 1 dynamic RAMS. Said RAMS are designated as MICRO D 4164-3 devices manufactured by NEC Corporation. Other types of bit map memories could be used. We will consider that the bit map memory is arranged into fifty address segments for one scan line. It should also be understood that the write clock operates at two megahertz and accordingly during one horizontal blank period, the bit map memory can receive seven 16 bit words from the buffer 23. When a segment of memory is selected by the address information on channel 39, the information on channel 37 is either written into or read out of memory. If information is to be written into the memory then there must be write enable signals present on channel 40 as will be explained hereinafter. The write enable signals are energized, or not energized, depending upon the combination of signals present on either the channels 47 or 49. If there is text information being transmitted on channel 37, then control information signals on channel 49 will be passed through the MUX 31 to selectively provide (or mask) the correct write enable signals. If graphic information is being transmitted on channel 37 then the control signals on channel 47 will be passed through the MUX 31 to selectively provide (or mask) the write enable signals. The bit map memory 33 transmits information signals to the CRT 51 through the shift register 53.

The bit map memory 33 is a memory device wherein there is a memory element for each pixel location on the CRT display 51. The CRT display device 51 is a standard CRT display device which can display twenty-four or twenty-five lines of text and wherein there are ten scan lines of the beam for each line of text. In the preferred embodiment the CRT display device is a VR 201 or VR 240 manufactured by Digital Equipment Corporation. As was mentioned above for each pixel location, or for each dot location, on the CRT device 51 there is a memory location in the bit map memory 33. In addition, in the bit map memory, which is employed in the preferred embodiment, there is sufficient memory means to accommodate eight additional text lines. While in the preferred embodiment, the bit map memory 33 actually accommodates 32.8 text lines, we shall consider in this discussion that the bit map memory 33 has the capacity to store thirty-two lines of text to be displayed. The information signals which are read from the bit map memory 33 are transmitted on channel 56, through the shift register 53 to the CRT 51.

Before we consider the operation of the circuitry shown in FIG. 1 with respect to a split screen smooth scrolling endeavor we should consider some further features of the GDC 19. The GDC 19 as mentioned earlier has the capacity to provide four starting addresses as well as four region length values, or region ending values. While the GDC 19 is capable and does act to provide graphic display information, its main role in this operation is the role of an address signals providing device. The address signals for information being read into the bit map memory 33 are transmitted on channel 25, along channel 35, through the MUX 29, through the decoder 45, along the channel 39 to the bit map memory. In a preferred embodiment the decoder 45 is a 74 LS 253 manufactured by Texas Instruments Corporation. Accordingly when pixel information from the microprocessor is transmitted to the buffer 23 and from the buffer 23 to the MUX 27, such information is located in the bit map memory at locations corresponding to the address signals from the GDC 19 as found on line 39. When the bit map memory 33 is to provide, or read out, information to the CRT 51, the GDC 19 provides address information signals on channel 39 to select locations in the bit map memory from whence such information for the CRT will be read. While it was mentioned above that the GDC 19 can provide four starting addresses and four region length values, it should be understood that not all operations require four such addresses. The significance of this matter will become better understood hereinafter. It should also be understood that the GDC device 19 includes at least two registers, one register being the current address register and the other register being the current region length register. The significance of the two registers will be better understood in view of the description below.

As mentioned earlier the GDC device 19 generates horizontal and vertical sync signals which enable the information to be transmitted throughout the system in the proper synchronization with respect to the electron beam of the CRT. Such horizontal and vertical sync signals are transmitted over the connection 57 to the CRT, to the shift register 53 and to the microprocessor 15. Write signals are transmitted over connection 32 to the buffer 23 and the destination counter 41. In accomplishing an output from the bit map memory to the CRT, the value represented in the address counter in the GDC is incremented by the write signals while the value represented in the region length register is decremented by horizontal sync signals. In addition, the vertical sync signals which are transmitted to the microprocessor 15 are used to increment or decrement the value of the address information in the RAM 18 and that control provides the basis for new starting address (SAD) information being transmitted to GDC 19. As was mentioned earlier a full scan line involves fifty addresses in the bit map memory and a full text line involves five hundred addresses. Thus at the end of ten line scans (which would constitute one line of text on the CRT), the starting address is changed by five hundred. As mentioned above the horizontal sync signals serve to decrement the length value in the length value register, so that when the length value in the length value register is equal to zero, the system knows that a predetermined region from the bit map memory has been displayed. After a predetermined region has been displayed, the system then provides a new starting address for the next region to be displayed. The new starting address (SAD) comes from the GDC device 19 and that address is transmitted along channels 25 and 35, through the MUX 29, through the decoder 45 and along the channel 39 to the bit map memory.

Figure 2:
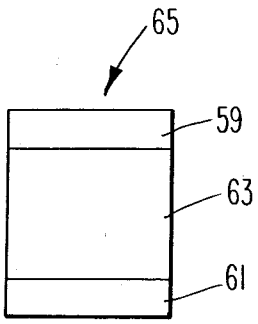
FIG. 2 is a layout of the display device screen.

If we examine FIG. 2, in view of the discussion of FIG. 1, we can better understand how the system operates. Assume that there is a document, for instance a business letter which has a fixed region 59 made up of two lines. By way of example the fixed region of two text lines 59, shown in FIG. 2, might consist of the letterhead of the organization as well as the title and name of the addressor such as Robert Smith, President. Assume that the business letter 65 has a lower fixed portion 61 which includes the address of the organization and some toll free telephone number. In accordance with the above assumptions, when the document 65 is shown on the screen, the fixed regions 59 and 61 will have used up four text lines of the possible twenty-four text lines shown on the screen. Assume further that the body of the letter starting with the name and address of the addressee, the salutation remarks and the closing expression constitutes some thirty lines of text. The body of the letter being depicted as region 63 in FIG. 2. As was mentioned earlier, the bit map memory has the capacity, in a preferred embodiment, to store thirty-two lines of text and also as was mentioned earlier a generally accepted standard, in the trade, is to have a CRT display device which displays twenty-four lines of text.

The "off screen" region of the bit map memory may have information therein which is used for various tasks in connection with display. However for purposes of discussion of this invention we will consider that the off screen region of memory is loaded with background material, i.e. no intelligence.

Figure 3:
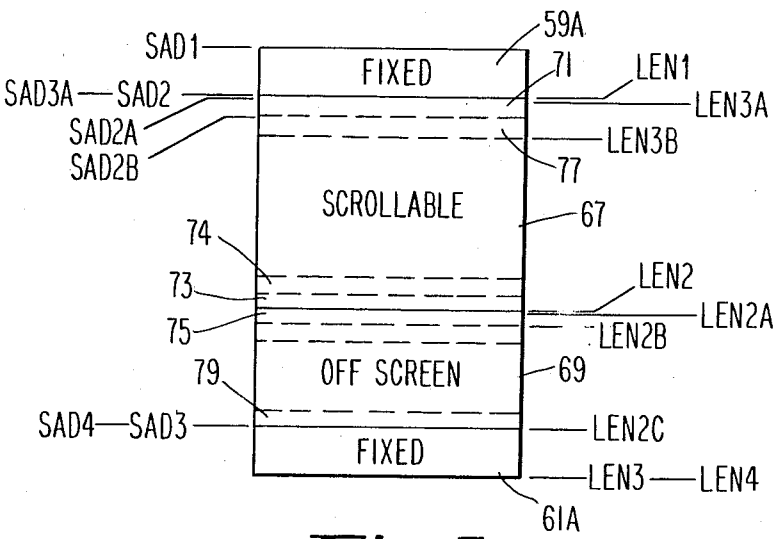
FIG. 3 is a layout of the bit map memory.

Consider now FIG. 3 which is exemplary of the bit map memory used in the preferred embodiment and which does have thirty-two text lines of memory available for display information. It should be understood that other memories of different capacities could be used. If we assume that the information representing the document 65, shown in FIG. 2, is in fact stored in the bit map memory depicted in FIG. 3 then we find that the upper fixed portion 59 of the letter 65 will be stored in the first two lines **59*a* of the bit map memory. Twenty of the thirty lines from the body 63, of the letter 65, will be stored in the scrollable region 67 of memory, while the lower fixed region 61 of the letter 65 will be stored in the lower two lines of 61*a* of memory shown in FIG. 3. The region 69 of memory between the lower fixed region 61*a* and the scrollable region 67** is the region wherein the off screen information is stored.

When the information has been stored in the bit map memory 33 as shown FIG. 3 and the read out of that information to the CRT is effected, the information in the upper fixed region 59A will appear in the upper portion of the display screen. The first twenty lines of the letter will appear thereunder, and the information stored in the lower fixed region 61A will appear as the last two lines on the screen.

Consider now that the system is going to operate in a split screen scrolling mode so that the thirty lines in the body of the letter may be viewed, as the body of the letter is scrolled. In order to accomplish this operation, the GDC device 19 will transmit to the bit map memory a first starting address (SAD 1) as shown in FIG. 3. At the same time an end of region value (LEN 1) will be stored in the end of region value register. It will be recalled that the LEN value is decremented by horizontal sync pulses (of which there are ten per text line) and hence the LEN 1 value in our example will equal twenty. When LEN 1 is decremented to zero as explained earlier, the system knows that the fixed region (59A) information has been transferred to the bit map memory and GDC 19 will transmit a second starting address (SAD 2) to the bit map memory. The second starting address (SAD 2) as shown in FIG. 3 will be the beginning of the first scan line of the third text line 71. It will be recalled that there are 500 addresses per text line, hence the SAD 2 value in our example will be one thousand. At the same time a second end of region value will be loaded into the end of region register in the GDC to be decremented in response to the horizontal sync signals. The LEN 2 value, as shown in FIG. 3, will be two hundred because the second region scan will involve twenty lines and each text line involves ten horizontal sync pulses. When the LEN 2 value has been decremented to zero the system knows that the scrollable region 67 has been displayed and the GDC 19 will transmit a third starting address SAD 3 as shown in FIG. 3. SAD 3 in our example will be fifteen thousand. At the same time a third end of region value (LEN 3) will be loaded into the end of region register in the GDC and that value in our example will be twenty. When the LEN 3 value has been decremented to zero the system will commence the second full scan of the bit map memory.

For the second full scan of the bit map memory, the GDC 19 will provide the same SAD 1 and LEN 1 that were provided before. However when the LEN 1 value has been decremented to zero, the second starting address will be SAD 2A, as shown in FIG. 3, and will represent the second scan line of the text line 71. The LEN 2A value will be the same as the LEN 2 value but the scan will proceed into the first scan line position of the off screen region of memory. Hence the scrollable region will advance one scan line at a time (within one frame) and the scrolling movement will be a smooth scroll. If the SAD 2 had been at position SAD 2B, which is the first scan line of text line 77, then the scroll would have jumped one text line at a time. The SAD will eventually be the value of SAD 2B and the second text line 77 will have been moved up on the screen to appear adjacent to the fixed region 59 and the information of text line 71 will have faded out. During this portion of the scroll the second end of region value will not change. When the text line 77 has moved adjacent to the fixed region 59, the first text line 75 of the off screen region will have been effectively moved into the scrollable region. Prior to or at about this time, information from the buffer would have been read into the off screen region, in particular into the text line 75, so that it will appear as the last line of the scrolling region on the screen, or in the position that the line 73 occupied prior to this first step of scrolling. As each LEN 2 value reaches zero, the GDC device 19 will provide SAD 3 and LEN 3 which will have the same values as before. The system will continue this operation and when the text line 79 in the off screen region has been displayed, which will be the twenty-eighth line of the body of the letter, the system is programmed to know that the off screen region has been exhausted. Accordingly the system must re-use that part of the memory wherein the text line 71 was originally loaded. The microprocessor 15 continually keeps tract of what the starting address is and hence when the starting address is five thousand, which represents the ninth text line of the split screen scrolling, the operation of the system changes to some extent. In the scrolling operation during which the ninth text line is the first line the LEN 2C value is one less than it was during the previous scrolling operation where the eighth line was the first line. The foregoing is true because the scrollable region during the scrolling operation wherein the ninth line is the first line will be reduced by one scan line when the scan reaches the fixed region 61A. Under these circumstances the third starting address will be SAD 3A, which is the same address as SAD 2 was for the first line scan of the text line 71. In this situation the LEN 3A value is one. To accommodate the scrolling operation when the tenth text line is the first line the LEN 2C value will be ten less than it was at the end of accommodating the ninth line so that the scan does not move into the fixed region 61A and the LEN 3B value will be twenty so that text line positions 71 and 77 of the bit map memory would now be in use.

It should be noted that in this reuse operation, each time LEN 3 value becomes zero a fourth starting address (SAD 4) would be employed as shown in FIG. 3 and a fourth region ending value (LEN 4) would be used in order to get the fixed region 61A onto the screen. The operation continues as just described with the LEN 2C value continually being decremented while the LEN 3 (A, B, etc.) value is increased in order to accomplish the wrap-around scrolling operation.

If we reflect upon our example we find that what would be happening is that in the initial part of the scrolling operation the addressee's name would initially be held on the screen by the phosphors, even though scan line by scan line less information is being transmitted from line 71 in the bit map memory. At the same time as the information from line 77 is transmitted to appear in that third line of the screen, the addressee's name would fade out and the addressee's address would appear on that first line. On the bottom part of the body of the letter the line 73 would have moved up to position 74 and the information in line 75 would be available for the position 73. Very often the information in the off screen region, in particular on line 75, is background information i.e. no intelligence and hence the background information would appear in position 73 but almost immediately thereupon intelligence would be written on the screen as the line 75 gets loaded with data from the buffer 23. It should also be understood that initially the end of region value does not change until all of the off screen region 69 has been used. Thereafter the end of region value gets decremented from the original scrolling region value and gets incremented for the new reused scrolling region. The fact that the new information can be added to the off screen region and that the scan of the bit map memory, which is underway, is permitted to scan into the off screen region (for the new information) permits the system to effect the the split screen smooth scrolling operation with an economy of hardware and time.

It will be recalled that the system can effect a reorganization if the size or the location of the scrollable region must be changed. It can be readily understood that reorganization of the bit map memory could be accomplished by commands from the main computer but it should be also understood that the main computer is burdened with doing all kinds of operations and that to use the time to reorganize the bit map memory would be a waste of the main computer time. In addition the reorganization of the bit map memory may be of local concern and indeed the information related to the local concern is available locally. For instance there may be many such CRT systems connected to to the main computer and the other systems do not want the organization of their bit map memories changed. Accordingly the present system provides for a local reorganization of the bit map memory.

Figure 4:
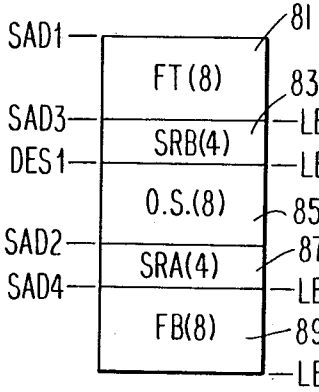
FIG. 4 is a layout of the bit map memory showing segments to be reorganized.

Let us suppose that the bit map memory ends after a split screen scrolling operation in the form shown in FIG. 4. In FIG. 4 there is shown a fixed top region 81 which has eight lines, followed by a scrolling region (SRB) 83 which has four lines, followed by an off screen region 85 which has eight lines, followed by a scrolling region (SRA) 87 which has four lines, and finally by fixed bottom region 89 which has eight lines. Let us suppose that the user wants to reorganize the system so that there can be a full screen scroll and the user wants the display to remain the same, i.e. as it appears shown in FIG. 6. To accomplish this the system is operated in the reorganization mode.

Figure 5:
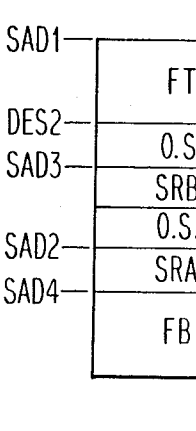
FIG. 5 is a layout of the bit map memory wherein one step of reorganization has been completed.

When the system operates in the reorganization mode the four line segment (SRB) 83 is moved to the first four lines of the off screen region 85 and this can be seen in FIG. 5. Segments of the foregoing are accomplished during both the vertical and horizontal blank periods. It is accomplished by having the GDC device 19 transmit a starting address through the MUX 29, through the decoder 45, along channel 39, to the bit map memory 33. This address is to effect the read out and hence the information at that address is read out on channel 91 to the latch 93. Thereafter the microprocessor 15 transmits a destination address on channel 95 to the destination counter 41, therefrom along channel 43 through the MUX 29, through the decoder 45, along the channel 39 to the bit map memory. Accordingly the information held by the latch 93 can be transmitted along the channel 97, along the channel 35 through the MUX 27, along the channel 37, back into the bit map memory to be located at the destination address provided by the counter 41. In the reorganization mode the value of the starting address register in the GDC is incremented in response to write signals and the value in counter 41 is incremented in response to write signals so that line by line the pixel information is transmitted from the bit map memory commencing at the starting address and returning to the destination address provided by the counter 41. In a similar fashion to that described before, when an LEN value has reached zero the system knows a certain segment of the memory has been relocated in accordance with the reorganization operation.

Figure 6:
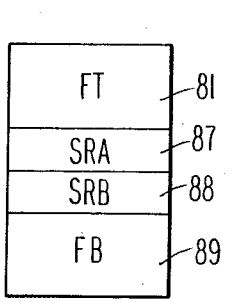
FIG. 6 is a layout of the screen of the display device toward which the reorganization of the bit map memory is directed.

If we examine FIG. 4 and FIG. 5, the operation just described becomes meaningful. During the reorganization operation the system is going to display the information as shown in FIG. 6 and accordingly SAD 1 is the first starting address as shown in FIG. 4. The LEN 1 value is at the end of the eight lines as shown in FIG. 4. The SAD 2 value is at the commencement of the SRA segment and the LEN 2 value is the end of the SRA segment. The SAD 3 value is at the commencement of the SRB segment and the LEN 3 value is at the end of the SRB segment. However it should be noted that at the beginning of the OS segment, the system has provided a destination address (DES 1). The system is programmed to effect a reorganization step. Hence the information from SRB is read out on channel 91 during vertical and horizontal blank times and will be relocated in the upper portion of the OS segment. The reorganization of the bit map memory after this first step can be seen in FIG. 5. When LEN 3 in FIG. 4 equals zero the system goes to SAD 4 and finishes with LEN 4 as described earlier. After the first step of the reorganization the bit map memory appears as shown in FIG. 5.

Figure 8:
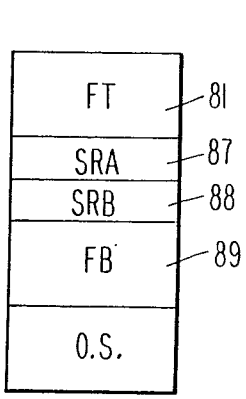
FIG. 8 is a layout of the bit map memory after a third step of reorganization has been completed.
Figure 7:
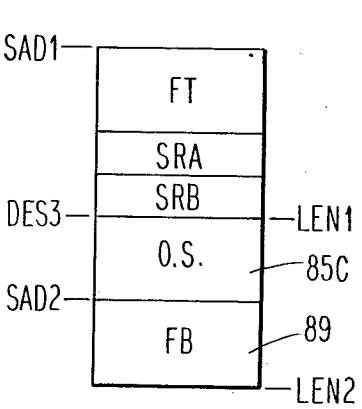
FIG. 7 is a layout of the bit map memory after a second step of reorganization has been completed.

In the second full scanning operation SAD 1 and LEN 1 are as shown in FIG. 5 and SAD 2 and LEN 2 are as shown in FIG. 5. It should be noted that the destination address 2 (DES 2) is also generated and the destination address 2 is the initial line scan of the OS segment 85A in FIG. 5. Accordingly the SRA segment 87 is readout from the bit map memory on channel 91 to be relocated in the bit map memory at the destination address (DES 2). Thereafter SAD 3 and LEN 3 as well as SAD 4 and LEN 4 will be employed to reorganize the bit map memory to appear as it does in FIG. 7. It can be seen in FIG. 7 that SRA is where SRB was in FIG. 4 and SRB is where the top portion of where OS was in FIG. 4. The final step of the reorganization is accomplished by providing SAD 1 as shown in FIG. 7 and permitting the scan to continue until the LEN 1 value in FIG. 7 is reached. The second SAD 2 signal is generated as shown in FIG. 7 at the same time the destination 3 (DES 3) signal is generated and hence the fixed bottom region 89 when it is read out from the bit map memory on channel 91 is returned to the (DES 3) address. This reorganization step places the information from segment 89 into the OS region 85C in FIG. 7 and hence after the third step of the reorganization the bit map memory is organized as shown in FIG. 8.

As can be seen from the foregoing discussion the GDC device 19 need only provide four starting addresses and four length values to accomplish any maneuvers that are necessary. It should also be understood that the off screen regions of the bit map memory become necessary in order to accomplish the foregoing maneuvers and in order to effect a split screen smooth scrolling operation. In the reorganization mode, the regions which are interchanged, or are to be moved, must first be moved into an off screen region where they can be stored and yet displayed so that the viewer is not really aware that the reorganization is taking place. It is imperative that the off screen regions lie adjacent to a scrollable region so that the scanning operation of the bit map memory can continue into the off screen region under the control of the end region value parameter as described above. By advancing the display one scan line per frame as just described, the split screen scrolling is a smooth operation rather than a "jump" operation of one text line at a time and of course smooth scrolling is one of the objectives of the present invention. The use of the GDC to provide the maximum of four starting addresses and four ending values makes for an economical way, hardwarewise, to provide addresses for every segment of the bit map memory.

We claim:

1. In a cathode ray tube display arrangement which is used to display information from a main computer means, and which employs a bit map memory means to store pixel information to be displayed a circuit for effecting a split screen smooth scrolling operation comprising in combination: microprocessor means coupled to said main computer means to receive instruction data, and address data therefrom as well as coded text signals, said microprocessor means including means to encode said coded text signals into arrays of bit signals defining text characters which represent said coded text; controller circuitry means connected to said microprocessor means and having logic circuitry and having at least an address register with an address value therein and a region length register with a region length value therein, said controller circuitry mean having means to store instruction signals and address signals received from said microprocessor and further having means to increment an address value in said address register by one in correspondence to each scan line of said cathode ray tube and further having means to decrement a region length value in said region length register by one in correspondence to each scan line of said cathode ray tube; first circuitry means connected to said microprocessor means to receive said array of bit signals therefrom and connected to said bit map memory means to transmit said array of bits signals thereto; second circuitry means connected to said controller circuitry means to receive address signals therefrom and connected to said bit map memory to transmit address signals thereto, whereby said controller circuitry means acts, to perform an addressing procedure by transmitting first starting address signals and succeeding address signals to said bit map memory means to casue pixel elements in a particular region of said bit map memory means to be read in a read-out procedure, scan line after scan line, until the region length value in said region length register is decremented to zero and whereby thereafter said addressing and read out procedure set out above is repeated with each succeeding starting address differing from the preceding starting address by one scan line so that the display corresponding to the section of the bit map memory which was first addressed fades away one scan line at a time.

2. In a cathode ray tube display arrangement, a circuit for effecting a split screen smooth scrolling operation according to claim 1, wherein said bit map memory means has a fixed region, a scrollable region and an off screen region which lies adjacent to said scrollable region and wherein said particular region is said scrollable region and wherein the length in said region value register causes said addressing and read out procedures to continue and thereby to read out pixel information from said off screen region.

3. In a cathode ray tube display arrangement, a circuit for effecting a split screen smooth scrolling operation according to claim 2 wherein said microprocessor means transmits new information to said off screen region and hence said pixel information read from said off screen region is new information.

4. In a cathode ray tube display arrangement, a circuit for effecting a split screen smooth scrolling operation according to claim 1 wherein said microprocessor means includes a read only memory which is formed to transmit an array of bit signals defining characters in response to receiving said coded text signals.

5. In a cathode ray tube display arrangement, a circuit for effecting a split screen smooth scrolling operation according to claim 1 wherein said controller circuitry means is formed to receive graphic bit signals from said microprocessor means and is formed and connected to transmit the same through a section of said first circuitry means.

6. In a cathode ray tube display arrangement, a circuit for effecting a split screen smooth scrolling operation according to claim 5 wherein said first circuitry means includes a first multiplexer which is formed to pass said array of bit signals in one mode and formed to pass said graphic bit signals in a second mode.

7. In a cathode ray tube display arrangement, a circuit for effecting split screen smooth scrolling operation according to claim 1 wherein said first circuitry means includes a buffer to receive said arrays of bit signals and hold the same until they are transmitted to said bit map memory.

8. In a cathode ray tube display arrangement, a circuit for effecting a split screen smooth scrolling operation according to claim 1 wherein said bit map memory means has a fixed region, a scrollable region and an off screen region and wherein said particular region is said scrollable region and wherein the length in said region value register causes said addressing and read out procedures to read out all of the pixel information in said off screen region and wherein thereafter the next new starting address represents the first scan line in said scrollable region so that at least a portion of said scrollable region of said bit map memory means is subject to being scanned a second time.

9. In a cathode ray tube display arrangement, a circuit for effecting a split screen smooth scrolling operation according to claim 8 wherein said microprocessor means transmits new information to the section of said scrollable region which was first scanned, whereby when said last mentioned section is subject to being scanned a second time new information will appear on the cathode ray tube display.

10. In a pixel information display arrangement wherein the amount of said information which is displayable is limited to X fixed test lines of pixel information and Y scrollable text lines of pixel information and wherein the arrangement may be used to display an additional, non displayed, Z scrollable lines of pixel information through a split screen scolling operation, wherein X, Y and Z are positive integers, a circuitry arrangement to effect a split screen smooth scrolling operation comprising in combination: CRT display means havihg a capacity to display a fixed region of said X text lines and a scrollable region of said Y text lines wherein each said text line comprises M scan lines; clock signal generator means formed to generate clock signals, horizontal sync signals and vertical sync signals; display memory means having a plurality of rows of pixel elements in sufficient numbers to store X plus text lines of pixel information as well as D text lines of off screen pixel information, said display memory means coupled to said display means to transmit pixel information thereto; data processing means; first circuity means connecting said data processing means to said display memory means to transmit pixel information thereto; control circuity means, including first logic circuitry and at least address register means having an address value therein and region ending register means having a region ending value therein, connected to said data processing means to receive address information and region ending information therefrom, said control circuitry means connected to said display memory means to transmit address signals thereto to direct pixel information being transferred to said display memory means to particular address therein; second circuitry means formed to connect said clock signal generator to said control circuitry to increment the value in said address register by a value representing a scan line and to decrement the value in said region ending register by a value representing a scan line thereby enabling said control circuitry to send a first starting address and succeeding addresses, with each address value differing by a value of one scan line, to said display memory means and to determine, in accordance with the value in said region ending register being decremented to zero, when all of the rows of pixel elements in a segment of memory have been scanned, and whereby thereafter each new starting address differs from the previous starting address by one scan line so that the display corresponding to the section of said display memory which was first addressed fades away one scan line at a time.

11. In a cathode ray tube display arrangement which is used to display information from a main computer source, and which employs a bit map memory means to store pixel information to be displayed, a circuit for effecting a reorganization of information stored in said bit map memory means comprising in combination: microprocessor means coupled to said main computer to receive instruction data and address data therefrom, said microprocessor formed to generate selection addresses and destination addresses; controller circuitry means connected to said microprocessor means and having logic circuitry and having at least an address register with an address value therein and a region length register with a value therein, said controller circuitry means having means to store instruction signals and address signals received from said microprocessor means and further formed to increment the value therein said address register and to decrement the value therein said region length register; first circuity means connecting said microprocessor means to said bit map memory means to transmit pixel information thereto; second circuit means connecting said bit map memory means to said first circuitry means whereby pixel information signals read from said bit map memory can be transmitted back into said bit map memory means; third circuitry means connected between said controller circuitry mean and said bit map memory means to transmit selection addresses to said bit map memory means; fourth circuitry means connected between said microprocessor mean and said third circuitry means to transmit destination addresses to said bit map memory mean whereby when pixel information is read from one segment of said bit map memory in accordance with a selection address, said pixel information is reinserted into said bit map memory at any one of a number of different addresses in said bit map memory.

* * * * *